US008790163B2

(12) United States Patent
Ke

(10) Patent No.: US 8,790,163 B2
(45) Date of Patent: Jul. 29, 2014

(54) MULTI-PURPOSE MACHINE FOR WALL PROCESSING

(75) Inventor: Ganxing Ke, Guangzhou (CN)

(73) Assignee: Ganxing Ke, Guangzhou (CN)

( * ) Notice: Subject to any disclaimer, the term of this patent is extended or adjusted under 35 U.S.C. 154(b) by 294 days.

(21) Appl. No.: 13/264,919

(22) PCT Filed: Apr. 17, 2010

(86) PCT No.: PCT/CN2010/071859
§ 371 (c)(1),
(2), (4) Date: Oct. 17, 2011

(87) PCT Pub. No.: WO2010/118704
PCT Pub. Date: Oct. 21, 2010

(65) Prior Publication Data

US 2012/0034852 A1 Feb. 9, 2012

(30) Foreign Application Priority Data

Apr. 17, 2009 (CN) ..... 2009 1 0038700

(51) Int. Cl.
*B24B 11/00* (2006.01)

(52) U.S. Cl.
USPC ..... 451/67; 451/344; 451/119; 451/124; 451/151; 451/154; 15/49.1; 15/50.1

(58) Field of Classification Search
CPC ..... B24B 7/182; A47L 11/38
USPC ..... 451/344, 119, 124, 151, 154, 340, 345, 451/358, 361, 67; 15/49.1, 50.1, 50.3, 52.1, 15/93.1; 156/575
See application file for complete search history.

(56) References Cited

U.S. PATENT DOCUMENTS 696,672 A * 4/1902 Glickman ..... 156/575
1,403,395 A * 1/1922 Egleston ..... 156/494

(Continued)

FOREIGN PATENT DOCUMENTS

CN 1445425 A 10/2003
CN 1530204 A 9/2004

(Continued)

OTHER PUBLICATIONS

Jul. 22, 2010 International Search Report issued in International Patent Application No. PCT/CN2010/071859.

(Continued)

*Primary Examiner* — George Nguyen
(74) *Attorney, Agent, or Firm* — Oliff PLC

(57) ABSTRACT

A multi-purpose machine for wall processing includes a base, a working member and a sliding device that drives the working member slide up and down relative to the base. The base includes a bottom board with moving wheels therebelow, a top board, and several parallel upright posts therebetween. The working member includes a cover and a roller set inside the cover. A built-in motor is set inside the roller. Wall processing tools are releasably fixed on the outside of the roller. A feeding hole is provided on the upper part of the cover and connected with a supply system or an absorbing system. The multi-purpose machine may perform operations including putty scraping, grinding and polishing, painting, cleaning and wall paper removing on the wall to replace human labor, thus realizing multiple purposes, reducing the labor strength, and improving the working efficiency.

13 Claims, 7 Drawing Sheets

(56) References Cited

U.S. PATENT DOCUMENTS

| | | | | | |
|---|---|---|---|---|---|
| 2,075,369 | A | * | 3/1937 | Stetler | 451/354 |
| 2,124,705 | A | * | 7/1938 | Locking | 451/354 |
| 2,238,757 | A | * | 4/1941 | Stevason | 15/98 |
| 2,323,963 | A | * | 7/1943 | Ames | 156/500 |
| 2,919,899 | A | * | 1/1960 | Hitchcock | 173/40 |
| 3,137,106 | A | * | 6/1964 | Griffith, Jr. | 451/352 |
| 4,163,301 | A | * | 8/1979 | Griffin | 15/50.1 |
| 4,199,905 | A | * | 4/1980 | Neidigh et al. | 451/92 |
| 5,042,208 | A | * | 8/1991 | Richardson | 451/354 |
| 5,240,503 | A | * | 8/1993 | Levy et al. | 118/323 |
| 5,567,197 | A | * | 10/1996 | Evensen | 451/358 |
| 5,772,496 | A | * | 6/1998 | Kurtz et al. | 451/296 |
| 5,775,979 | A | * | 7/1998 | Coke et al. | 451/87 |
| 5,964,645 | A | * | 10/1999 | Jemt | 451/41 |
| 5,966,772 | A | * | 10/1999 | Woodnorth et al. | 15/230.11 |
| 6,336,852 | B1 | * | 1/2002 | Roos | 451/352 |
| 6,966,825 | B2 | | 11/2005 | Ke | |
| 8,262,436 | B2 | * | 9/2012 | De Gobbi | 451/41 |
| 2002/0007988 | A1 | * | 1/2002 | Tachibana | 188/1.11 E |
| 2005/0115352 | A1 | * | 6/2005 | Tanaka | 74/490.03 |
| 2005/0196246 | A1 | * | 9/2005 | Kojima et al. | 409/135 |
| 2008/0248725 | A1 | * | 10/2008 | Craycraft | 451/28 |
| 2009/0127956 | A1 | * | 5/2009 | Ozaki et al. | 310/90.5 |

FOREIGN PATENT DOCUMENTS

| | | | |
|---|---|---|---|
| CN | 1624271 | A | 6/2005 |
| CN | 2737499 | Y | 11/2005 |
| CN | 101004105 | A | 7/2007 |
| CN | 101538928 | A | 9/2009 |

OTHER PUBLICATIONS

Jul. 22, 2010 Written Opinion of the International Searching Authority issued in International Patent Application No. PCT/CN2010/071859.

* cited by examiner

MULTI-PURPOSE MACHINE FOR WALL PROCESSING

FIELD OF INVENTION

The present invention relates to a machine for wall processing, which realizes multiple purposes including putty scraping, grinding and polishing, painting, cleaning and wall paper removing on the wall to replace human labour.

BACKGROUND OF INVENTION

The current situation related to the processes of wall putty scraping, grinding and polishing, painting, cleaning and wall paper removing is illustrated as follows. (1) The processes of putty scraping, grinding and polishing on the wall are carried out manually by human world widely. (2) The painting process is carried out by a roller, an air sprayer or an airless sprayer, which may incur the difficulty in cleaning the paint accidentally dropped on the floor and environmental pollution to some extent. For example, the air sprayer or the airless sprayer needs the atomization of the paint at first, and the atomized paint may float in the air and cause damages to the health of an operator. (3) The cleaning of the wall (such as a glass wall), especially for the large hall like an airport or a stadium and the glass curtain wall is carried out manually by human, which causes the strong working strength and high risk. (4) The removal of the wall paper is carried out by an evaporation generator and human operations, which has the problem of low efficiency.

Prior to this application, PRC Patent No. 200310111959.4 and U.S. Pat. No. 6,966,825 of the inventor of the present invention publish "wall/roof polisher," which has the deficiencies of a single purpose, a complicated structure and unsmooth attachment to the working surface.

SUMMARY OF THE INVENTION

The present invention is mainly directed to a multi-purpose machine for wall processing, which may perform operations including putty scraping, grinding and polishing, painting, cleaning and wall paper removing on the wall to replace human labour, thus realizing multiple purposes, reducing the labour strength, and improving the working efficiency.

To achieve the above objectives, the present invention adopts the following technical scheme.

The multi-purpose machine for wall processing of the present invention includes a base, a working member and a sliding device that drives the working member slide up and down relative to the base. The base includes a bottom board with moving wheels therebelow and a top board, and several parallel upright posts between the bottom board and the top board. The working member includes a cover and a roller set inside the cover. A built-in motor is set inside the roller. Wall processing tools are releasably fixed on the outside of the roller. A feeding hole is provided on the upper part of the cover and connected with a supply system or an absorbing system.

The sliding device includes a motor fixed on the base, and the motor is connected with two sliding blocks by a transmission system. Two sides of the working member are respectively connected with the two sliding blocks, and the two sliding blocks are respectively confined to slide along two sliding rails. In accordance with different wall heights or other requirements, the two sliding rails may be vertically fixed between the bottom board and the top board. Or, the two sliding rails are vertically fixed between the upper support plate and the lower support plate, and the support posts parallel to the sliding rail are further disposed between the two support plates. The top board has a hole for the support posts to penetrate and slide, and the lower support plate has a hole for the upright posts to penetrate and slide, so that the support posts are confined to slide in a direction parallel to the upright posts.

The transmission system may be a steel cord and plural pulleys mounted on the top board, the bottom board, the upper support plate and the lower support plate.

In the use of the multi-purpose machine for wall processing of the present invention, according to different purposes, different wall processing tools may be selected to be fixed on the outside of the roller. For grinding and polishing, the tool fixed on the outside of the roller is sandpaper. For putty scraping, painting or wall cleaning, the tool fixed on the outside of the roller is drum. For removing the wall paper, the tool fixed on the outside of the roller is plural ring blades spaced by a certain interval.

When the multi-purpose machine for wall processing of the present invention is used for putty scraping, painting, wall cleaning or removing the wall paper, a supply system is connected with the feeding hole. The supply system includes a reservoir for containing paint, putty, cleaning agent or solvent, an inlet of the reservoir is connected with an air pump or an extrusion device, and an outlet of the reservoir is detachably connected with the feeding hole on the upper part of the cover by a soft hose. The reservoir, the air pump or the extrusion device are fixed on the top board or the upper support plate.

When the multi-purpose machine for wall processing of the present invention is used for grinding and polishing the wall, an absorbing system is connected with the feeding hole, and the absorbing system includes a vacuum cleaner, the vacuum cleaner is detachably connected with the feeding hole on the upper part of the cover by a soft hose. The vacuum cleaner is fixed on the top board or the upper support plate. The vacuum cleaner is used for absorbing dusts generated in grinding.

For uniformly distributing the paint, putty, cleaning agent or solvent on the upper part of the working member, the feeding hole on the upper part of the cover is in a flat shape. The feeding hole is connected with the soft hose by a trumpet-shaped or triangular connector. A narrow end of the connector is connected with the soft hose, and a wide end of the connector is connected with the feeding hole. The connector and the cover may be fabricated separately, and the connector and the cover may be integrated. The connection position of the soft hose should be deviated from the center so as to reduce the chance of contacting the steel cord.

For processing the corners of the wall, the uneven or irregular wall and the edges of the ceiling where the working member of the wall processing cannot reach, an electrical or manual sprinkler connected with the reservoir is fixed on one side of the cover.

For processing the concave wall, in the multi-purpose machine for wall processing of the present invention, any one of the sliding blocks that slides along the sliding rail slide includes a defining portion disposed at the back and a protruding portion disposed in the front. The defining portion has at least one set of pulleys, the sliding rail corresponding to the sliding block are placed between the pulleys, and the sliding block is confined to slide up and down relative to the sliding rail. The protruding portion includes a frame and a fixed block fixed with the working member, the fixed block is confined to move front and back along the frame, and an offsetting spring is disposed between the fixed block and the back side of the frame.

The structure for confining the fixed block to move front and back along the frame is illustrated as follows.

One beam and two bars are fixed in the frame of the protruding portion of the sliding block, the beam and the bars penetrate the fixed block, the pulleys are mounted between the fixed block and the beam, the offsetting spring is sleeved on the bars and is disposed between the fixed block and the back side of the frame, the beam and the bars are perpendicular to the sliding rail, and an upper part and lower part of the fixed block respectively have a set of pulleys that slide on the surface of the frame.

The structure may also be realized as follows.

Two bars are fixed in the frame of the protruding portion of the sliding block, two linear bearings are mounted in the fixed block, and the two bars respectively penetrate two linear bearings; and the offsetting spring is sleeved on the bars and is placed between the fixed block and the back side of the frame, and the bars are perpendicular to the sliding rail.

In the sliding block of this structure, on one hand, the working member is the protruding portion fixed on the front part of the sliding block, so the working member protrudes out of the front part of the wall processing machine and may get into the concave wall for working. On the other hand, on the basis that the working member is guaranteed to move smoothly up and down along the sliding rail, as the fixed block fixed with the working member can move front and back relative to the sliding block and may be resiliently return to its normal position, which enables the working member working on the working surface tightly all the time.

The top board or the upper support plate fixed with the sliding rail adopts the following structure. The front end of the top board or the upper support plate fixed with the sliding rail protrudes farther than the front end of the bottom board or the lower support plate fixed with the sliding rail. The lower part of the top board or the upper support plate fixed with the sliding rail has two protruding posts, and when the sliding block moves upwardly to the top end of the sliding rail, the two sliding blocks respectively reach the two protruding posts. With this structure, when the working member is at the top end of the sliding rail, the working member will not collide with the top board or the upper support plate, which may guarantee that the working member moves smoothly front and back and is kept working tightly on the working wall.

To ensure the working member of the multi-purpose machine for wall processing of the present invention suffer the force within a certain range and will not collide with the wall to cause damage, the front ends of the bottom board, the top board, the upper support plate and the lower support plate are respectively provided with plural mounting holes, and in each mounting hole, the positioning rod is fixed. To reduce the weight of the overall machine, the bottom board, the top board, the upper support plate and the lower support plate are made to be hollow inside to the maximum extent, and are provided with the mounting holes for the pulleys of the transmission device.

To adjust the working depth of the working member, such as the grinding and polishing depth and the thickness of the paint, the front side of the cover is provided with two positioning wheels with the regulating device.

The top board or the upper support plate fixed with the sliding rail is provided with plural mounting holes for fixing the working member. The working member is fixed on the upper part of the top board or the upper support plate. The wall processing machine of the present invention may perform all kinds of wall processing operations on the roof. To ensure the working member working tightly on the roof, a spring is disposed between the working member and every mounting hole.

The cover is a semi-enclosed structure on the outside of the roller. The roller partially protrudes out of the cover, which may reduce the pollution to the working environment to the maximum extent. The front side of the cover is provided with a top positioning wheel and a bottom positioning wheel with the regulating device, which can adjust the working depth according to the requirement. The upper part of the cover has a flat feeding hole.

The roller has one groove, one motor is fixed in the roller, and a sealing washer is disposed on an outer edge of the two side shafts of the roller.

To realize the automatic operation, the motor of the sliding device and the built-in motor of the roller may be connected with an electronic control circuit.

The multi-purpose machine for wall processing of the present invention is operated as follows. Firstly, different tools and different supply or absorbing systems are selected to be mounted according to different wall processing requirements. For grinding and polishing, a sandpaper is mounted on the roller, and the vacuum cleaner is connected to the feeding hole. For the putty scraping, painting or wall cleaning, a drum is mounted on the roller, and the reservoir that contains the paint, the putty or the cleaning agent is connected to the feeding hole. For removing the wall paper, a ring blade is mounted on the roller, and the reservoir containing the solvent is connected to the feeding hole. The operator handholds the base without efforts and lean the working member to the wall, and then working member is driven by the sliding device to slide up and down and process the wall.

The multi-purpose machine for wall processing of the present invention can realize different functions and multiple purposes and is simple and efficient just by replacing the tools of the working member. The structures of the sliding block, the bottom board, the top board, the upper support plate and the lower support plate are subtly designed, so that the wall processing machine may process the concave walls and may work on the wall tightly all the time. The multi-purpose machine of the present invention may perform operations including putty scraping, grinding and polishing, painting, cleaning and wall paper removing on the wall to replace human labour, thus realizing multiple purposes, reducing the labour strength, improving the working efficiency and ensuring the working safety.

DETAILED DESCRIPTION OF THE INVENTION

Hereinafter, the present invention is described in details with reference to the embodiments in accompanying with the drawings.

Figure 1:
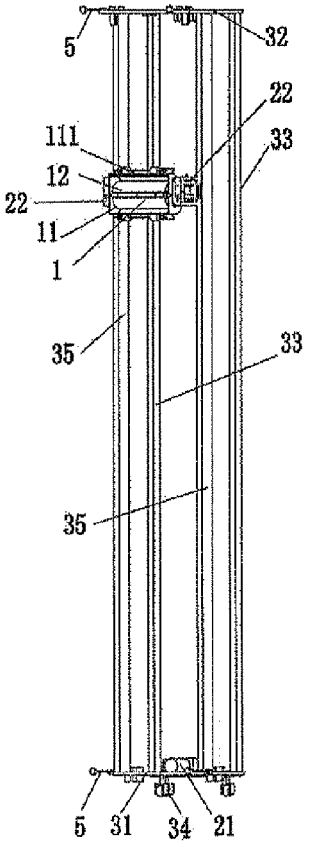
FIG. 1 is a schematic structural view of a multi-purpose machine for wall processing of the present invention, in which the sliding rail is vertically fixed between the bottom board and the top board.
Figure 2:
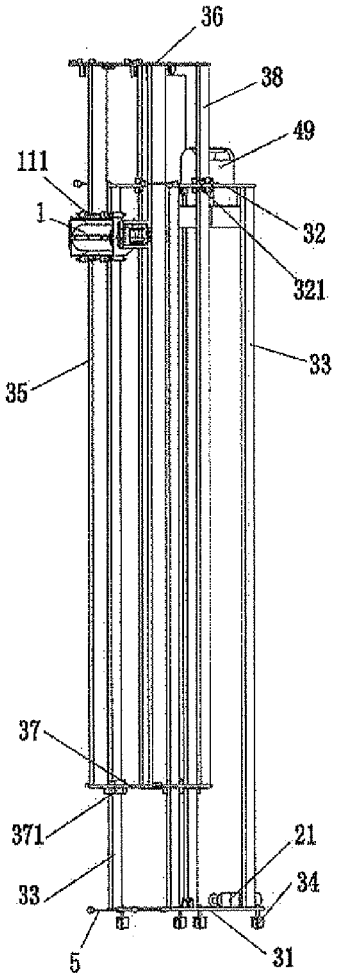
FIG. 2 is a schematic structural view of a multi-purpose machine for wall processing of the present invention according to another embodiment, in which the sliding rail is vertically fixed between the upper support plate and the lower support plate, support posts parallel to the sliding rail are disposed between two support plates, and the support posts are confined to slide parallel to the upright posts.

According to wall height or user's requirements, the multi-purpose machine for wall processing of the present invention may be fabricated into a single column type (as shown in FIG. 1) or two-segment type (as shown in FIG. 2) or multi-segment column type (not shown).

As shown in FIG. 1, the multi-purpose machine for wall processing of this embodiment includes a base, a working member 1 and a sliding device that drives the working member 1 slide up and down relative to the base. The base includes a bottom board 31 with moving wheels 34 therebelow, a top board 32, and several parallel upright posts 33 between the bottom board 31 and the top board 32. The working member 1 includes a cover 11 and a roller set inside the cover 12. A built-in motor (not shown) is disposed in a roller hole 12, and wall processing tools are releasably on the outside of the roller 12. A feeding hole 111 is provided on the upper part of the cover 11 and connected with a supply system (not shown) or an absorbing system (not shown). The sliding device includes a motor 21 fixed on the bottom board 31 of the base. The motor 21 is connected with two sliding blocks 22 by a transmission system (the transmission system includes a steel cord and plural pulleys, which is not shown). Two sides of the working member 1 are respectively connected with the two sliding blocks 22, and the two sliding blocks 22 are respectively confined to slide along two sliding rails 35. The two sliding rails 35 are vertically fixed between the bottom board 31 and the top board 32. The motor 21 is actuated and the steel cord pulls the working member 1 to move along the sliding rail 35, thus processing the wall. The front sides of the top board 32 and the bottom board 31 are provided with positioning rods 5 for ensuring that the working member of the wall processing machine suffers the force in a certain range and will not collide with the wall to cause damage.

As shown in FIG. 2, the two-segment type multi-purpose machine for wall processing is illustrated in this embodiment. The base includes a bottom board 31, a top board 32, four upright posts 33 vertically fixed between the bottom board and the top board, an upper support plate 36, a lower support plate 37 and two sliding rails 35 and two support posts 38 vertically fixed between the upper and the lower support plates. The top board 32 has a hole 321 for the support posts 38 to penetrate and slide and the lower support plate 37 has a hole 371 for the upright posts 33 to penetrate and slide, so the sliding rail 35 and the support posts 38 may slide parallel to the upright posts 33. When the motor 21 pulls the working member 1 to reach the upper support plate 36 by the steel cord, the motor 21 continuously pulls the whole frame constituted of the upper support plate 36, the lower support plate 37, the sliding rail 35 and the support posts 38 by the steel cord, so that the working member 1 continuously moves upwardly to the required height for processing the wall. In FIG. 2, a vacuum cleaner 49 is fixed on a top board 32, and the vacuum cleaner 49 is connected with the feeding hole of the cover by a soft hose (not shown), for absorbing the dusts generated in grinding and polishing. Definitely, the vacuum cleaner 49 may also be fixed on the upper support plate 36.

Figure 3:
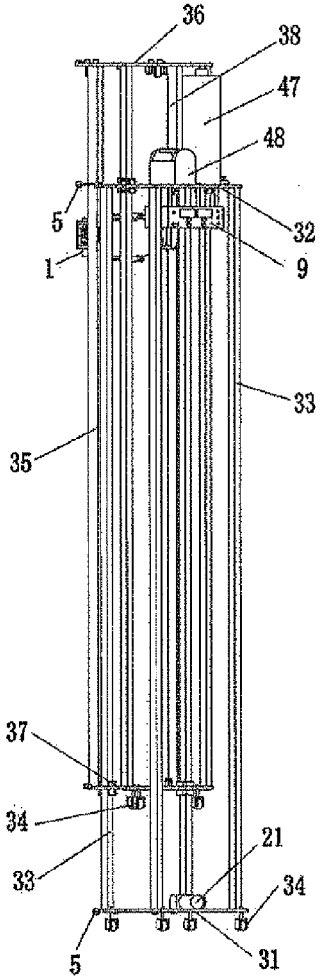
FIG. 3 is a schematic structural view of a multi-purpose machine for wall processing of the present invention according to still another embodiment.

The different between the embodiment in FIG. 3 and the embodiment in FIG. 2 lies in that, a reservoir 47 having the air pump 48 is fixed on the top board 32, for squirting the paint, the cleaning agent, the solvent and the like. An electronic controller 9 is disposed below the top board 32, and the electronic controller 9 is connected with a motor 21 on the bottom board 31 and a built-in motor in the roller 12 and a photo switch, thereby realizing the automatic operation of the wall processing machine.

Figure 8:
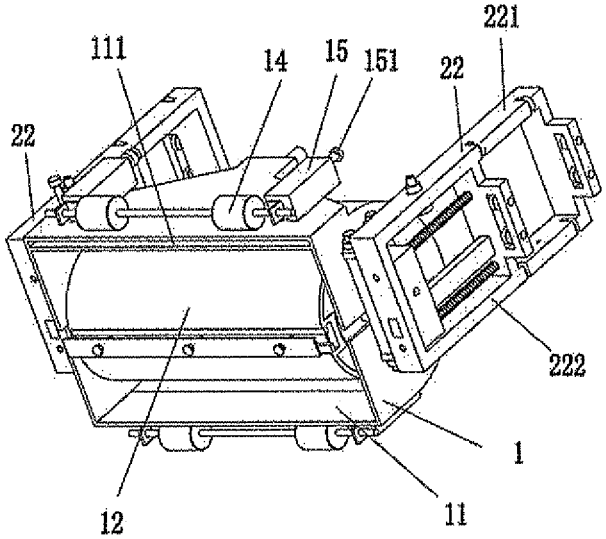
FIG. 8 is a schematic structural view of a working member and a sliding block.

The structure of the working member 1 is illustrated in FIG. 8.

The working member 1 includes a cover 11 and a roller 12. The cover 11 is a semi-enclosed structure on the outside of the roller 12, and a front part of the roller 12 protrudes out of the cover 11. The roller has one groove, one motor (not shown) is fixed in the roller, and a sealing washer is disposed on an outer edge of the two side shafts of the roller.

Figure 4:
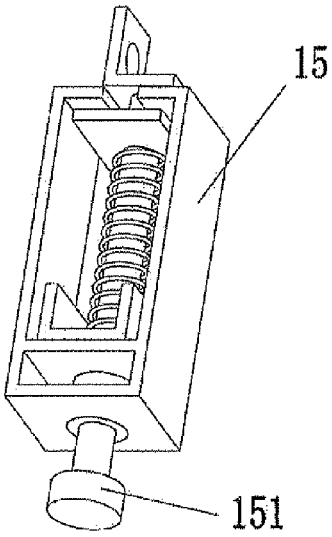
FIG. 4 is a schematic structural view of a positioning wheel regulating device for adjusting a working depth of a working member.

The left and right sides of the working member 1 are connected with the sliding block 22, and the front ends on the top and bottom sides of the working member 1 has positioning wheels 14. The positioning wheels 14 are provided with the regulating device 15, and the structure of the regulating device 15 is shown in FIG. 4. The position of the positioning wheel 14 at front and back may be adjusted by rotating the bolt 151 in the regulating device 15, thereby effectively controlling the working depth of the working member 1, such as the grinding depth and the thickness of the paint.

Figure 5:
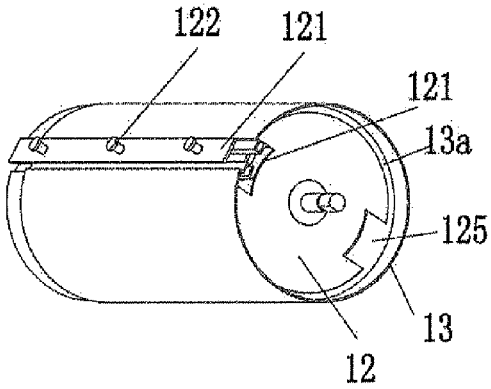
FIG. 5 is a schematic structural view of a roller of a working member for grinding and polishing.

FIG. 5 is a schematic structural view of a roller 12 of a working member for grinding and polishing. The sandpaper 13 and the tail end of the sponge 13*a* on the lower part of the sandpaper are tightly pressed in the groove 125 of the roller 12 by two battens 121 and plural screws 122, thereby fixing the sandpaper, for wall grinding and polishing.

Figure 6:
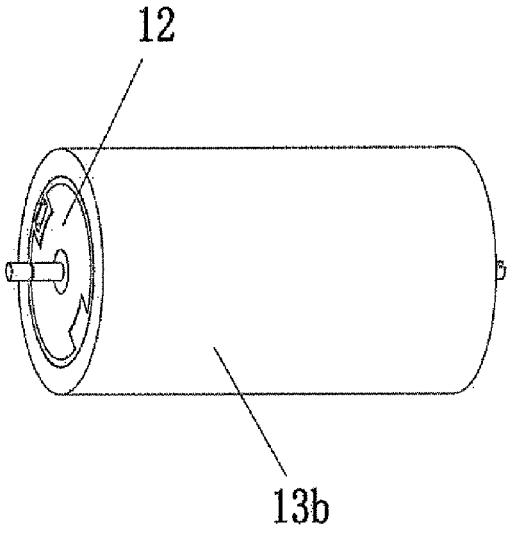
FIG. 6 is a schematic structural view of a roller of a working member for putty scraping, painting of wall cleaning.

As shown in FIG. 6, a drum or a drum cloth 13*b* is securely sleeved on the roller 12, for putty scraping, painting, wall cleaning or the like.

Figure 7:
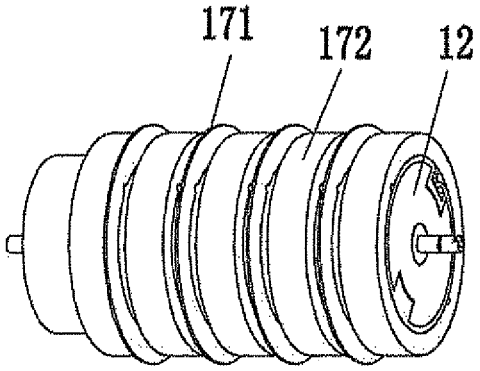
FIG. 7 is a schematic structural view of a roller of a working member for removing a wall paper.

As shown in FIG. 7, several ring blades 171 and several gaskets 172 are fixed alternately on the roller 12, for removing the wall paper.

Figure 9:
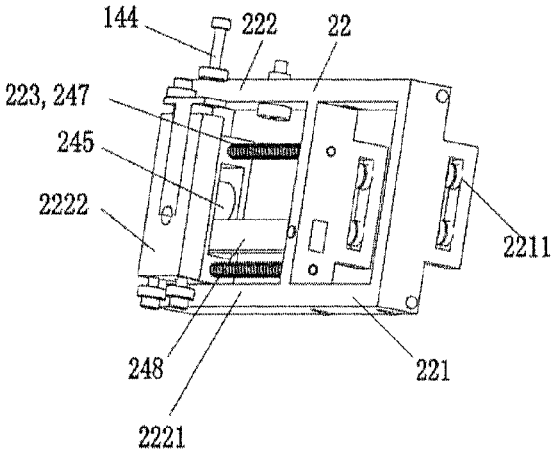
FIG. 9 is a schematic structural view of the sliding block.

FIG. 8 clearly illustrates the structure relations of the sliding block 22 and the working member 1. As shown in FIG. 2, two parallel sliding rails 35 vertically fixed below the upper support plate 36, two sides of the working member 1 are respectively connected with the front part of the sliding block 22, and the back part of the sliding block 22 is confined to slide up and down along the sliding rail 35. The structure of the sliding block 22 is shown in FIG. 9. The sliding block 22 includes a defining portion 221 disposed at the back and a protruding portion 222 disposed in the front. The defining portion has two pairs of pulleys 2211, the sliding rail 35 corresponding to the sliding block 22 is placed between the pulleys 2211, and the sliding block 22 is confined to slide up and down relative to the sliding rail 35. The protruding portion 222 includes a frame 2221 and a fixed block 2222 that is fixed to the working member 1. The fixed block 2222 is confined to move front and back along the frame 2221, and an offsetting spring 223 is disposed between the fixed block 2222 and the back side of the frame 2221. The fixed block 2222 is fixed to the cover 11 of the working member 1 by the bolt 144. For confining the fixed block to move front and back along the frame, the structure in FIG. 9 may be adopted and other structures may also be adopted.

As shown in FIG. 9, one beam 248 and two bars 247 are fixed in the frame 2221 of the protruding portion of the sliding block. The beam 248 and the bars 247 penetrate the fixed block 2222, pulleys 245 are mounted between the fixed block and the beam, and the offsetting spring 223 is sleeved on the bar 247 and is disposed between the fixed block and the back side of the frame. The beam 248 and the bars 247 are perpendicular to the sliding rail 35, and the upper and lower ends of the fixed block respectively have a set of pulleys that slide on the surface of the frame.

If the two bars penetrate the fixed block 2222 through the linear bearing, the beam 248 and the pulleys 245 may be omitted.

Figure 10:
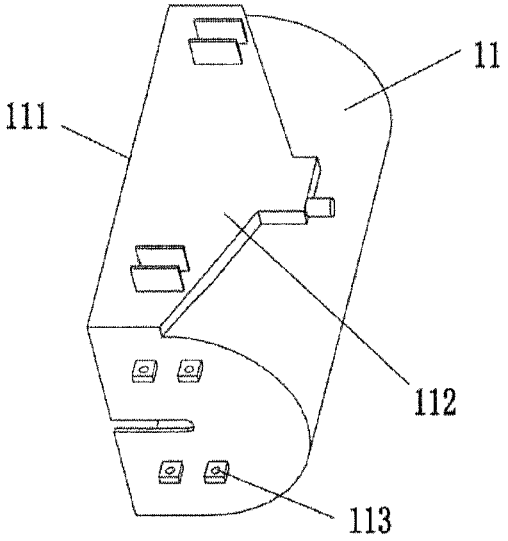
FIG. 10 is a schematic structural view of a cover of the working member.

FIG. 10 is a schematic structural view of a cover. The two sides of the cover 11 are connecting holes 113 for connecting the sliding block 22, and the upper part of the cover 11 is a flat feeding hole 111. The feeding hole 111 is connected with a feeding soft hose (not shown) by a triangular connector 112, so that the materials like the paint and the putty can be uniformly distributed on the flat feeding hole 111, thus realizing the purpose of uniform distribution on the roller 12.

As shown in FIG. 3, the materials are stored in the reservoir 47, and when pressurized by the air pump 48, the materials are transported to the feeding hole 111 on the upper part of the cover 11 through the soft hose (not shown).

Figure 11:
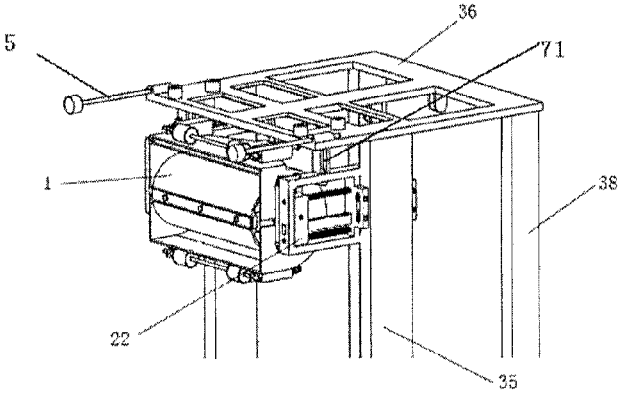
FIG. 11 is a schematic structural view of a working member and a sliding rail and an upper support plate according to an embodiment in FIG. 3.

FIG. 11 clearly illustrates the structure relations of the working member 1 and the sliding rail 35 and the upper support plate 36 in FIG. 3.

Figure 12:
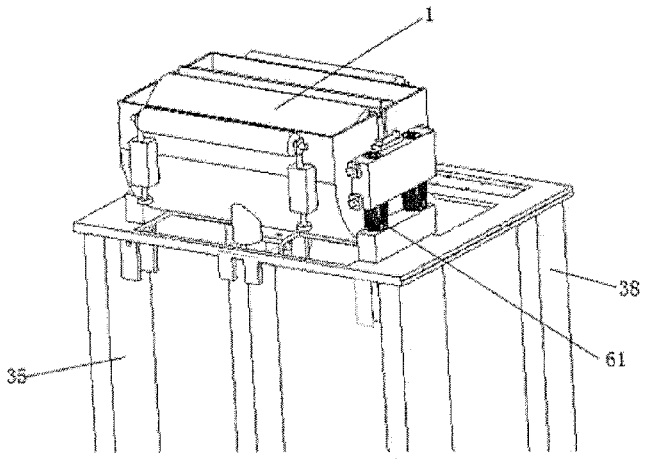
FIG. 12 is a schematic structural view of a working member fixed on the top board or the upper support plate for processing a roof.

For performing the operations such as putty scraping, grinding and polishing, painting or cleaning, the working member 1 may be fixed above the upper support plate 36, and the opening of the cover 11 faces upwards, as shown in FIG. 12. To keep the working member 1 attached to the roof tightly, a spring 61 is disposed between the working member 1 and every mounting hole.

To reduce the weight of the overall machine and the length of the positioning rod, the bottom board 31, the top board 32, the upper support plate 36 and the lower support plate 37 are provided with the mounting holes for mounting the pulleys, the positioning rod 5 and the working member 1 and a hole 75 for the upright posts and support posts to penetrate and slide.

Figure 13:
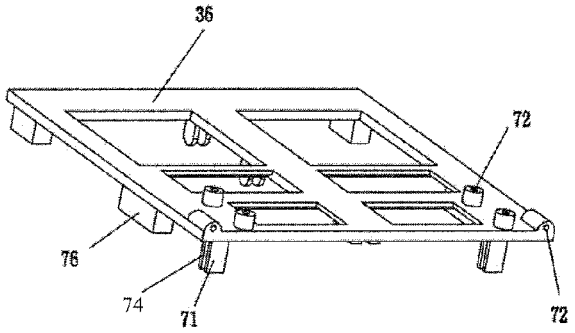
FIG. 13 is a schematic structural view of an upper support plate according to an embodiment in FIG. 2.
Figure 14:
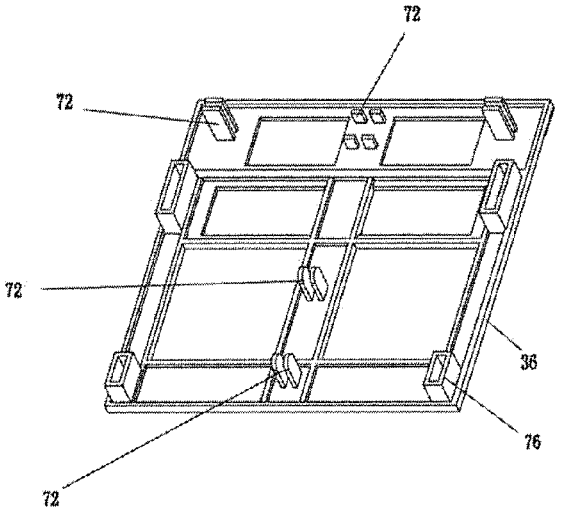
FIG. 14 is a schematic structural view of the upper support plate in FIG. 13 when observed from bottom.

FIG. 13 is a schematic structural view of an upper support plate 36 of the two-segment type multi-purpose machine for wall processing. In the figure, 71 indicates the protruding posts. When the sliding blocks 22 move upwardly to the top end of the sliding rail, the two sliding blocks 22 respectively reach the two protruding posts 71. Mounting holes 74 are disposed inside the protruding posts 71 for mounting the pulleys where the steel cord (not shown) is winding. In the middle and back parts of the upper support plate 36, the mounting holes 74 are also disposed for mounting the pulleys where the steel cord (not shown) is winding, as shown in FIG. 14. 76 indicates the mounting holes for fixing the sliding rail or the support posts. 72 indicates the mounting holes for fixing the positioning rod 5. 73 indicates the mounting holes for the working member 1 when the working surface is roof.

Figure 15:
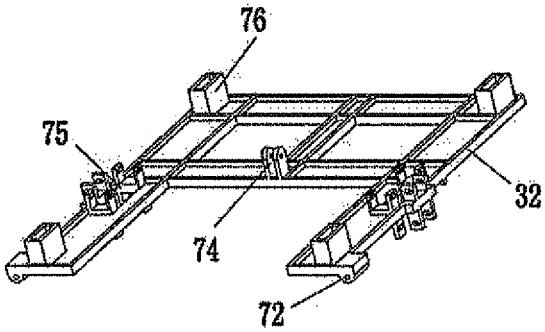
FIG. 15 is a schematic structural view of a top board according to the embodiment in FIG. 2.

FIG. 15 is a schematic structural view of a top board 32 of the two-segment type multi-purpose machine for wall processing. 76 indicates the mounting holes for the fixed upright posts, 72 indicates the mounting holes for the fixed positioning rod, 75 indicates the holes for the support posts to penetrate and slide, and pulleys are disposed on the side of the hole, and 74 indicates the mounting holes for the pulleys where the steel cord is winding.

Figure 16:
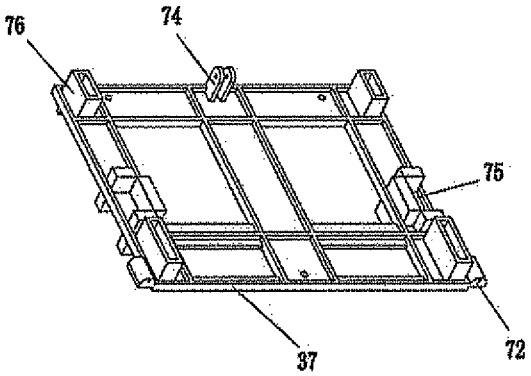
FIG. 16 is a schematic structural view of a lower support plate according to the embodiment in FIGS. 2.

FIG. 16 is a schematic structural view of a lower support plate 37 of the two-segment type multi-purpose machine for wall processing. The structure of the hole 75 for the upright posts to penetrate and slide is the same as that of the hole 75 for the support posts to penetrate and slide in FIG. 15, and pulleys (not shown) are also disposed on the side of the hole 75, thereby limiting the move. 72 indicates the mounting holes for the fixed positioning rod, 76 indicates the mounting holes for the fixed sliding rail or the support posts and 74 indicates the mounting holes for the pulleys where the steel cord is winding.

Figure 17:
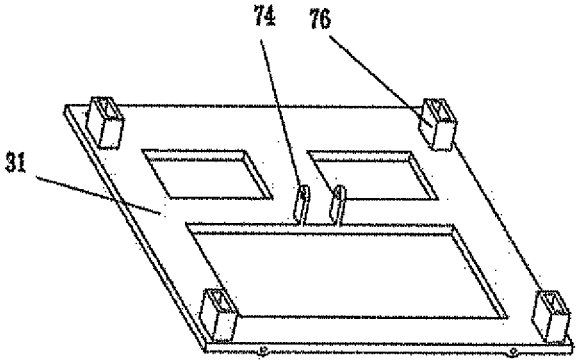
FIG. 17 is a schematic structural view of a bottom board according to the embodiment in FIG. 2.

FIG. 17 is a schematic structural view of a bottom board 31 of the two-segment type multi-purpose machine for wall processing. 76 indicates the mounting holes for the fixed upright posts, 72 indicates the mounting holes for the fixed positioning rod and 74 indicates the mounting holes for the pulleys where the steel cord is winding.

For the single post multi-purpose machine for wall processing, the structure of the top board is illustrated in FIG. 13 and the structure of the bottom board is illustrated in FIG. 17.

The above descriptions are merely taken as the preferred embodiment of the present invention, but not intended to restrict the present invention. Any modification, equivalent replacement, and improvement that fall within the spirit and principle of the present invention are included in the protection scope of the claims of the present invention.

What is claimed is:

1. A multi-purpose machine for wall processing, comprising:

a base, having a bottom board with moving wheels therebelow, a top board, and several parallel upright posts between the bottom board and the top board;

a working member; and a sliding device, for driving the working member slide up and down relative to the base;

wherein the working member comprises a cover and a roller set inside the cover; a built-in motor is set inside the roller; wall processing tools are releasably fixed on the outside of the roller; a feeding hole is provided on the upper part of the cover and connected with a supply system or an absorbing system, wherein the sliding device comprises a motor fixed on the base, the motor is connected with two sliding blocks by a transmission system, two sides of the working member are respectively connected with the two sliding blocks, and the two sliding blocks are respectively confined to slide along two sliding rails of the base;

the two sliding rails are vertically fixed between the bottom board and the top board; or the two sliding rails are vertically fixed between the upper support plate and the lower support plate, and support posts parallel to the sliding rail are further disposed between the two support plates; the top board has a hole for the support posts to penetrate and slide; and the lower support plate has a hole for the upright posts to penetrate and slide.

2. The multi-purpose machine for wall processing according to claim 1, wherein the supply system connected with the feeding hole comprises a reservoir for containing paint, putty, cleaning agent or solvent, an inlet of the reservoir is connected with an air pump or an extrusion device, and an outlet of the reservoir is detachably connected with the feeding hole on the upper part of the cover by a soft hose; and the reservoir, the air pump or the extrusion device is fixed on the top board or the upper support plate;

the absorbing system connected with the feeding hole comprises a vacuum cleaner, the vacuum cleaner is detachably connected with the feeding hole on the upper part of the cover by a soft hose; and the vacuum cleaner is fixed on the top board or the upper support plate.

3. The multi-purpose machine for wall processing according to claim 2, wherein the feeding hole on the upper part of the cover is in a flat shape, and the feeding hole is connected with the soft hose by a trumpet-shaped or triangular connector; and a narrow end of the connector is connected with the soft hose, and a wide end of the connector is connected with the feeding hole.

4. The multi-purpose machine for wall processing according to claim 2, wherein an electrical sprinkler or a manual sprinkler connected with the reservoir is fixed on one side of the cover.

5. The multi-purpose machine for wall processing according to claim 1, wherein any one of the sliding blocks comprises a defining portion disposed at the back and a protruding portion disposed in the front; the defining portion has at least one set of pulleys, the sliding rails corresponding to the sliding blocks are placed between the pulleys, and the sliding blocks are confined to slide up and down relative to the sliding rail; the protruding portion comprises a frame integrated or fixed with the defining portion and a fixed block that is fixed with the working member, the fixed block is confined to move front and back along the frame, and an offsetting spring is disposed between the fixed block and the back side of the frame.

6. The multi-purpose machine for wall processing according to claim 5, wherein one beam and two bars are fixed in the frame of the protruding portion of the sliding block, the beam and the bars penetrate the fixed block, the pulleys are mounted between the fixed block and the beam, the offsetting spring is sleeved on the bars and is disposed between the fixed block and the back side of the frame, the beam and the bars are perpendicular to the sliding rail, and an upper part and a lower part of the fixed block respectively have a set of pulleys that slide on the surface of the frame.

7. The multi-purpose machine for wall processing according to claim 5, wherein two bars are fixed in the frame of the protruding portion of the sliding block, two linear bearings are mounted in the fixed block, and the two bars respectively penetrate the two linear bearings; and the offsetting spring is sleeved on the bars and is placed between the fixed block and the back side of the frame, and the bars are perpendicular to the sliding rail.

8. The multi-purpose machine for wall processing according to claim 5, wherein the front end of the top board or the upper support plate fixed with the sliding rail protrudes farther than the front end of the bottom board or the lower support plate fixed with the sliding rail; the lower part of the top board or the upper support plate fixed with the sliding rail has two protruding posts, and when the sliding block moves upwardly to the top end of the sliding rail, the two sliding blocks respectively reach the two protruding posts.

9. The multi-purpose machine for wall processing according to claim 1, wherein the front side of the bottom board, the top board, the upper support plate and the lower support plate is provided with a mounting hole for fixing the positioning rod, the upper part or the lower part is provided with a mounting hole for mounting the pulleys of the transmission system; and the upper part of the top board or the upper support plate fixed with the sliding rail is provided with plural mounting holes for fixing the working member.

10. A multi-purpose machine for wall processing, comprising:

a base, having a bottom board with moving wheels therebelow, a top board, and several parallel upright posts between the bottom board and the top board;

a working member; and a sliding device, for driving the working member slide up and down relative to the base;

wherein the working member comprises a cover and a roller set inside the cover; a built-in motor is set inside the roller; wall processing tools are releasably fixed on the outside of the roller; a feeding hole is provided on the upper part of the cover and connected with a supply system or an absorbing system, wherein the cover is a semi-enclosed structure on the outside of the roller, the roller partially protrudes out of the cover; and the front side of the cover is provided with a top positioning wheel and a bottom positioning wheel each of which having a regulating device, and the upper part of the cover has a flat feeding hole.

11. The multi-purpose machine for wall processing according to claim 1, wherein the wall processing tools fixed on the outside of the roller comprise a sandpaper, a drum or plural ring blades spaced by a certain interval.

12. The multi-purpose machine for wall processing according to claim 1, wherein the cover is a semi-enclosed structure on the outside of the roller, the roller partially protrudes out of the cover; and the front side of the cover is provided with a top positioning wheel and a bottom positioning wheel with the regulating device, and the upper part of the cover has a flat feeding hole.

13. The multi-purpose machine for wall processing according to claim 1, wherein the roller has one groove, one motor is fixed in the roller, and a sealing washer is disposed on an outer edge of the two side shafts of the roller.

* * * * *